US009743693B2

(12) United States Patent
Zambelli

(10) Patent No.: US 9,743,693 B2
(45) Date of Patent: Aug. 29, 2017

(54) COVER AND METHOD FOR COVERING PART OF AN UNDERGARMENT

(71) Applicant: Caryn Zambelli, Caldwell, NJ (US)

(72) Inventor: Caryn Zambelli, Caldwell, NJ (US)

( * ) Notice: Subject to any disclaimer, the term of this patent is extended or adjusted under 35 U.S.C. 154(b) by 12 days.

(21) Appl. No.: 14/599,648

(22) Filed: Jan. 19, 2015

(65) Prior Publication Data

US 2016/0206015 A1 Jul. 21, 2016

(51) Int. Cl.
*A41C 3/00* (2006.01)
*A41C 3/08* (2006.01)
*A41F 15/00* (2006.01)

(52) U.S. Cl.
CPC ..... *A41C 3/08* (2013.01); *A41F 15/00* (2013.01)

(58) Field of Classification Search
CPC ..... A41C 3/12; A41C 3/105; A41F 15/007; A41F 15/002; A41F 15/02; A41F 9/007; A63B 33/002; A45F 3/12; A41D 27/08
USPC ..... 2/336, 338, 244, 246, 267, 268; 450/86, 450/1
See application file for complete search history.

(56) References Cited

U.S. PATENT DOCUMENTS 4,575,874 A * 3/1986 Johnson ..... A41F 15/007 2/460
4,945,576 A 8/1990 Melton
5,144,696 A 9/1992 Kahl
5,172,428 A * 12/1992 Leinoff ..... A41D 5/00 2/181
5,201,078 A * 4/1993 Melton ..... A41F 15/007 2/267
5,287,559 A * 2/1994 Christiansen ..... A42B 1/248 2/181
5,428,844 A * 7/1995 Dougherty ..... A42B 1/248 2/181
5,566,871 A * 10/1996 Weintraub ..... A45F 3/12 2/268
5,626,507 A * 5/1997 Gillen ..... A41C 3/105 2/268
5,803,792 A * 9/1998 Roush ..... A41F 15/007 2/267
5,857,220 A * 1/1999 Erny ..... A41D 27/08 2/209.13
6,279,168 B1 * 8/2001 Bean ..... A42B 1/248 2/195.1
6,339,848 B1 * 1/2002 Mayhood ..... A41F 9/002 2/338
6,406,354 B1 6/2002 Yamauchi et al.
6,752,466 B2 * 6/2004 Liang ..... B60R 22/00 280/808
6,859,945 B1 * 3/2005 Crawford ..... A41F 9/007 2/336
8,357,025 B2 1/2013 Brydon
8,469,772 B2 6/2013 Crouch
9,173,440 B1 * 11/2015 Crouch ..... A41F 15/02
2010/0071118 A1 * 3/2010 Tobey ..... A63B 33/002 2/452

(Continued)

*Primary Examiner* — Gloria Hale
(74) *Attorney, Agent, or Firm* — Thomas L. Adams

(57) ABSTRACT

A cover can be installed on an undergarment having a back strap and a pair of shoulder straps. The cover has a casing for covering the back strap. The casing is adapted to extend from one of the pair of shoulder straps to the other. An outer garment can be worn over the undergarment that is fitted with the cover.

8 Claims, 6 Drawing Sheets

(56) References Cited

U.S. PATENT DOCUMENTS

| | | | | |
|---|---|---|---|---|
| 2011/0230120 | A1* | 9/2011 | Tully | A41C 3/12 450/88 |
| 2011/0269376 | A1 | 11/2011 | Clim | |
| 2012/0028539 | A1 | 2/2012 | McCarty | |
| 2012/0045597 | A1 | 2/2012 | Ponce | |
| 2012/0324631 | A1* | 12/2012 | Peper | A41F 15/02 2/244 |

* cited by examiner

COVER AND METHOD FOR COVERING PART OF AN UNDERGARMENT

BACKGROUND OF THE INVENTION

1. Field of the Invention

The present invention relates to apparatus in the field of undergarments, and in particular, to a device for covering portions of an undergarment that might be exposed through an outer garment with a relatively open back.

2. Description of Related Art

Brassieres come in various styles. Many brassieres have a horizontal strap with releasable closures in the back or in the front which circles the chest of the wearer.

In FIG. 1 outer garment 10 is a top with an open back 12 bordered at the neck with a cinch 10A. The wearer P is also wearing an undergarment 14, namely a brassiere (bra) with a backstrap 16 that can be fastened/unfastened at clasp 16A. Undergarment 18 is shown with the conventional shoulder straps 18 and 20 attached to the left and right, respectively, of backstrap 16. It will be noticed that backstrap 16 and portions of shoulder straps 18 and 20 are visible through open back 12.

The bodice of many women's garments in modern style have this open back, which exposes the horizontal bra strap 16. Exposure of this strap is often considered unattractive or aesthetically unpleasant. Moreover for many of these styles, the exposure of the bra's shoulder straps is also considered aesthetically undesirable.

See also U.S. Pat. Nos. 4,945,576; 5,144,696; 6,406,354; 8,357,025; and 8,469,772; as well as US Patent Application Publication Nos. 2011/0269376; 2012/0045597; and 2012/0324631.

SUMMARY OF THE INVENTION

In accordance with the illustrative embodiments demonstrating features and advantages of the present invention, there is provided a cover for an undergarment having a back strap and a pair of shoulder straps. The cover includes a casing for covering the back strap. The casing is adapted to extend from one of the pair of shoulder straps to the other.

In accordance with another aspect of the present invention, a method is provided for covering a back strap of an undergarment having a pair of shoulder straps. The method employs a casing. The method includes the step of placing the casing about the back strap to cover it at least partially. Another step is extending the casing along the back strap from one of the shoulder straps to the other. The method also includes the step of donning an outer garment over the undergarment.

By employing apparatus and methods of the foregoing type, a novel cover is provided for covering portions of an undergarment that might be exposed through the open back of an outer garment. For example, one can cover the backstrap of a brassiere that would otherwise be exposed through a garment that has a relatively open back. To install the cover, the backstrap, when open, is threaded into a tubular cover. The backstrap can then be closed and the cover stretched to reach from one shoulder strap to the other. This cover can be made of an attractive material and can be adorned with decorative elements, so others see a relatively attractive article instead of a utilitarian and less-than-attractive rear bra strap.

The cover may be fastened to the shoulder straps to ensure full coverage from shoulder strap to shoulder strap. In one case snaps are attached to the rim of the openings of a tubular cover. At each end the snaps may be pulled past the shoulder strap to a position just above the bra's backstrap, before being snapped together. This not only provides full coverage, but applies an outward pressure to the shoulder straps, causing them to bow outwardly and slide under portions of the outer garment adjacent to the open back.

In some embodiments the ends of a tubular cover can be fastened to the bra's shoulder straps with a releasable tether. The tether can be affixed to the end of the tubular cover and can wrap around the shoulder strap before being fastened back onto the cover.

In some embodiments a relatively stiff panel is laminated onto an inside face of the cover. This panel tends to stretch the cover longitudinally so the cover will bear against the bra's shoulder straps.

Some bras are fastened in the front and therefore the backstrap does not open. In that case the cover may have a longitudinal split that allows the cover to be wrapped around the backstrap before closing the cover along the longitudinal split. The closure at the longitudinal split may be a zipper, snaps, or other means.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 2:
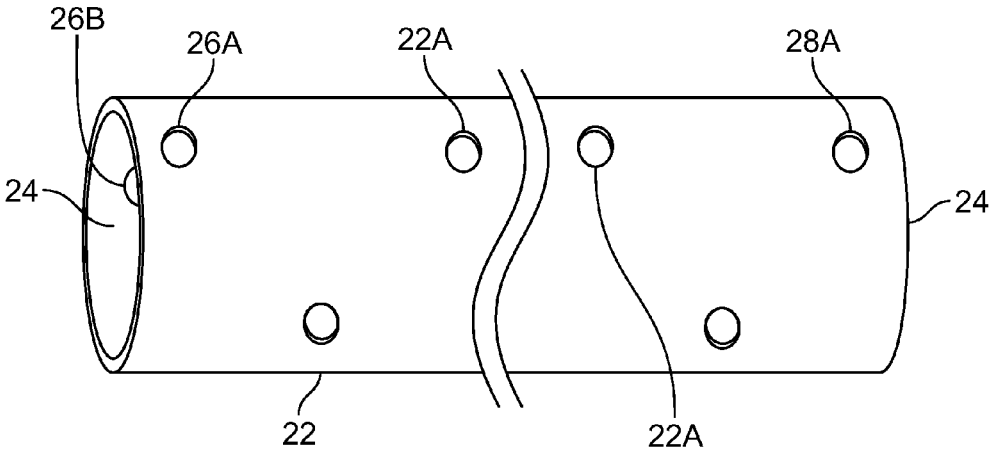
FIG. 2 is perspective view of a cover in accordance with principles of the present invention.

Referring to FIG. 2, the illustrated cover 22 is a tubular casing (also referred to as a tube or jacket) with an opposing pair of openings 24. Cover 22 can be made from any of a variety of fabrics, including knit or weaved fabrics, plastic sheets or sheets made from entangled fibrous material. To give cover 22 some stretchability, some embodiments may use knit nylon or polyester blended with spandex. In some cases the cover 22 will be fabrics of nylon, polyester or other fibers that stretch due to the design of the knit. Other embodiments may use rubberized materials or flexible plastics such as polyethylenes and thermoplastic polyurethanes. Any of the forgoing material may be blended or laminated together to form a composite. In particular the outer surface of cover 22 may have a pleasant appearance and may be a layer of actual or imitation cotton, silk, chiffon, crepe, denim, etc. In some cases the outer surface of cover 22 may be a smooth surface suitable for printing, embossing, coloring, receiving appliques or charms, etc.

A pair of fasteners 26A and 26B are installed near the annular rim of opening 24 (left end of FIG. 2) at locations that are angularly spaced about 120° apart (two o'clock and 10 o'clock positions), although other angular spacings may be employed in other embodiments. A complementary pair of fasteners are installed at the opposite (right) end, again 120° apart, only one of them (fastener 28A) being visible in this Figure. Fasteners 26A, 26B, and 28A are releasable snaps.

Cover 22 is adorned with a number of decorative elements 22A. While elements 22A are illustrated as small round objects, in some embodiments they may be larger objects with an arbitrary outline. Elements 22A may be plastic emblems, metal studs, stickers, decals, printed indicia, small mirrors, three dimensional typographic characters, sequins, relief images, real or artificial jewels (precious or semiprecious), etc. In some cases elements 22A may be molded items depicting celebrities, historic buildings, sports equipment, team logos, classic automobiles, common household items, pets, etc. In some cases, the decorative elements may be a single element that spans across cover 22, banner-like. In still other cases, cover 22 can be a fabric (or a fabric sheath) with a pleasant color or pattern, and will not have separate, distinct decorative elements.

In some cases, elements 22A may be LEDs or other types of lights that are illuminated continuously or intermittently. These lights can flash randomly to produce a twinkling effect or can be illuminated in a sequence to produce a ticker tape effect. If densely packed, these lights can be used to produce images that are either static, changing, or animated.

In some embodiments the cover 22 may have a different appearance on the opposite side and may be reversed, right to left, or rotated 180° along its axis to present this other appearance. In addition, in some embodiments the inside of cover 22 may have a different appearance and the cover may be turned inside out to present that other appearance. In still other embodiments, the appearance of cover 22 may be varied by using a replaceable skin that is secured by adhesive, hook and loop fasteners, etc.

Figure 3:
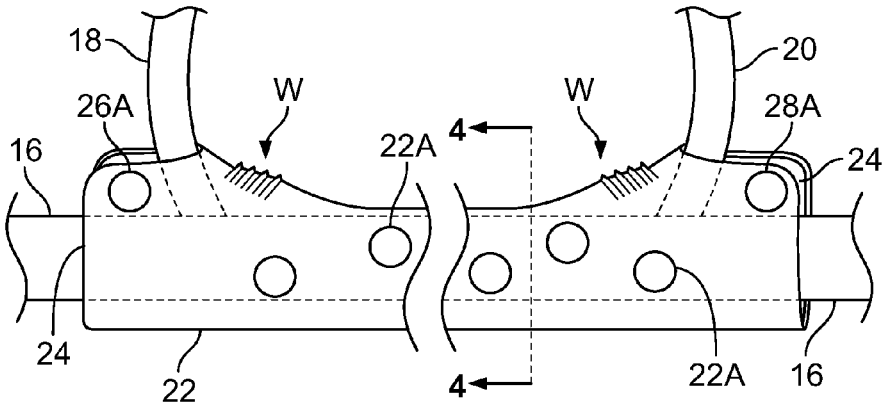
FIG. 3 is a perspective view of the cover of FIG. 2 installed on an undergarment.
Figure 4:
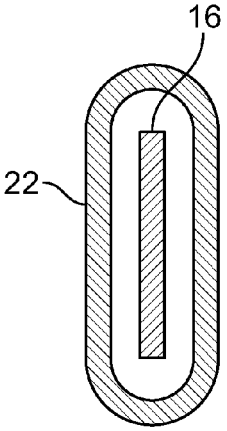
FIG. 4 is a cross-sectional view taken along line 4-4 of FIG. 3.

To facilitate an understanding of the principles associated with the foregoing apparatus, its operation will be briefly described with reference to FIGS. 1-5. In FIG. 3 previously mentioned back strap 16 (FIG. 1) is shown threaded through cover 22 and emerging from its opposite ends 24. This threading is achieved by opening back strap 16 at clasp 16A and threading one side of the unclasped back strap through cover 22, before closing clasp 16A and stretching the cover so it reaches between shoulder straps 18 and 22.

Snaps 26A and 26B (FIGS. 2 and 3) are then pulled past shoulder strap 18 and snapped together above back strap 16. Likewise, snap 28A and its mate are snapped together above back strap 16 and to the outside of shoulder strap 20. Thus, snap 26A and its mate (snap 28A and its mate) form a passageway for shoulder strap 18 (20) and another passageway for back strap 16. These passageways are also referred to as annular entranceways.

Figure 1:
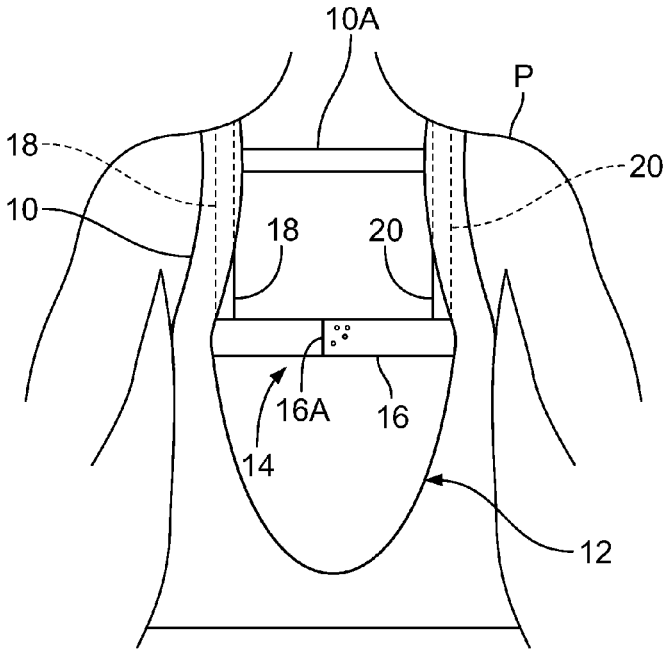
FIG. 1 (Prior Art)
FIG. 1 is a rear elevational view of a person wearing an outer garment over an undergarment, in accordance with the prior art.

This installation of cover 22 may be performed while back strap 16 is located dorsally as shown in FIG. 1. Alternatively, the installation may be performed with back strap 16 positioned anteriorly. After this installation, bra 14 will be spun azimuthally 180°, before lifting into place shoulder straps 18 and 20 and the bra's front cups (not shown).

The fastened positions of snaps 26A and 28A and their mates tends to stretch the portion of opening 24 around shoulder straps 18 and 20 and the resulting tension tends to push the shoulder straps outwardly and down toward the back strap 16. This is accompanied by wrinkling in regions W. Consequently, shoulder straps 18 and 20 bow outwardly causing them to slide behind outer garment 10 either completely (as in FIG. 5), or partially. Therefore, open back 12 no longer reveals straps 16, 18 and 20, and reveals instead the pleasantly decorated cover 22.

Figure 6:
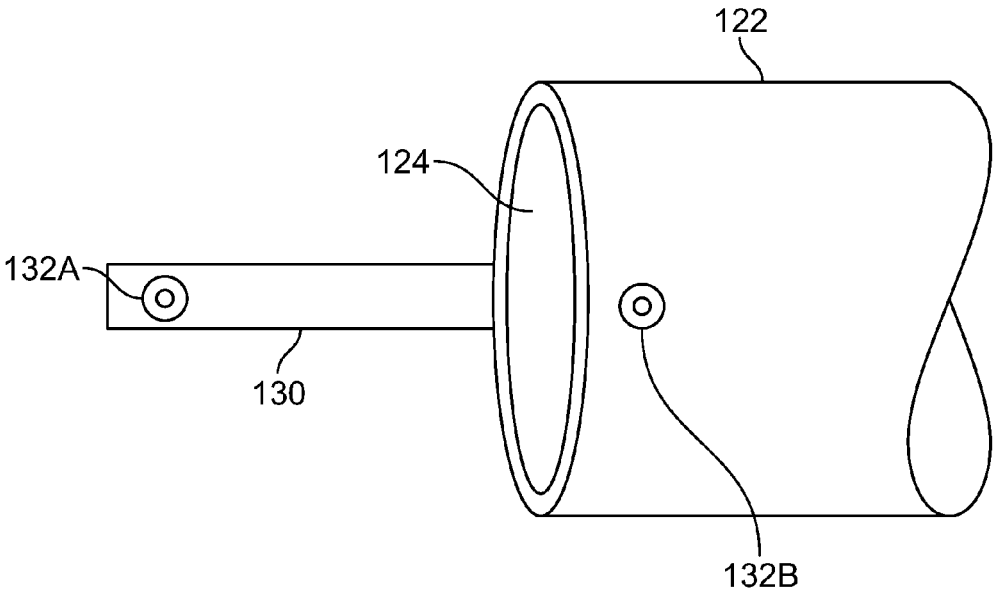
FIG. 6 is a fragmentary, perspective of one end of a cover that is an alternate to that shown in the above Figures.
Figure 7:
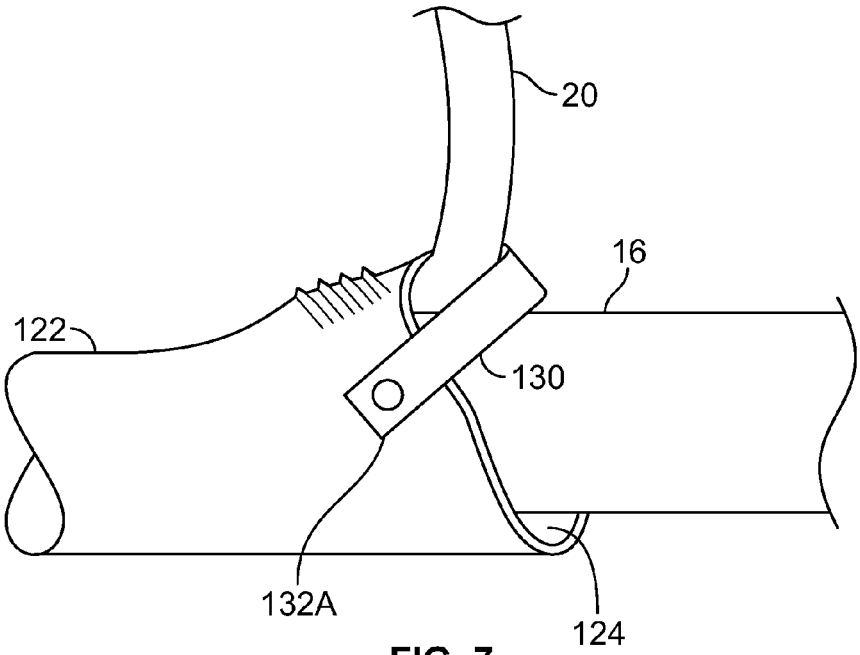
FIG. 7 is fragmentary, perspective of one end of the cover of FIG. 6 shown installed on an undergarment.

Referring now to FIGS. 6 and 7, alternative cover 122 may be a tube formed of materials as previously described. However, cover 122 has a fastener that is different from that described above. Specifically, a separate pair of tethers 130 are attached to each of the opposing ends 124 of cover 122. The proximal end of tether 130 is affixed to cover 122 by stitches, staples, rivets, adhesive, or the like. Snap element 132A on the distal end of tether 130 is designed to snap onto its mate 132B on the opposite side of cover 122.

As before, back strap 16 may be undone and threaded into cover 122 before closing the strap 16 at clasp 16A. Cover 122 is then stretched to shoulder straps 18 and 22 and held in place using tethers 130. Specifically, tether 130 is routed around the outside of shoulder strap 20 as shown in FIG. 7. Only shoulder strap 20 is shown in FIG. 7 but the other shoulder strap 18 is tethered in a complementary fashion.

Installation of tethers 130 tends to stretch the portion of opening 124 around shoulder straps 18 and 22 and the resulting tension tends to push the shoulder straps outwardly and down toward the back strap 16. As before, shoulder straps 18 and 20 bow outwardly causing them to slide behind an outer garment (garment 10 of FIG. 5). Therefore, the pleasantly decorated cover 122 is exposed, but not the associated bra components.

Figure 8:
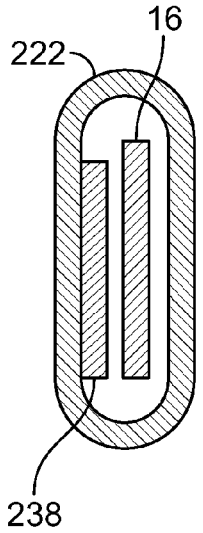
FIG. 8 is a cross-sectional view of a cover that is an alternate to that shown in the above Figures.

Referring to FIG. 8, alternative cover 222 may be a tube formed of the previously described materials and may have either the fastener of FIG. 3 or 6. Cover 222 has a stiffener 238 in the form of a panel attached to the inside of the cover by adhesives, stapling, riveting, etc. Stiffener 238 may also be secured by placement in pockets formed in the cover 222.

Figure 5:
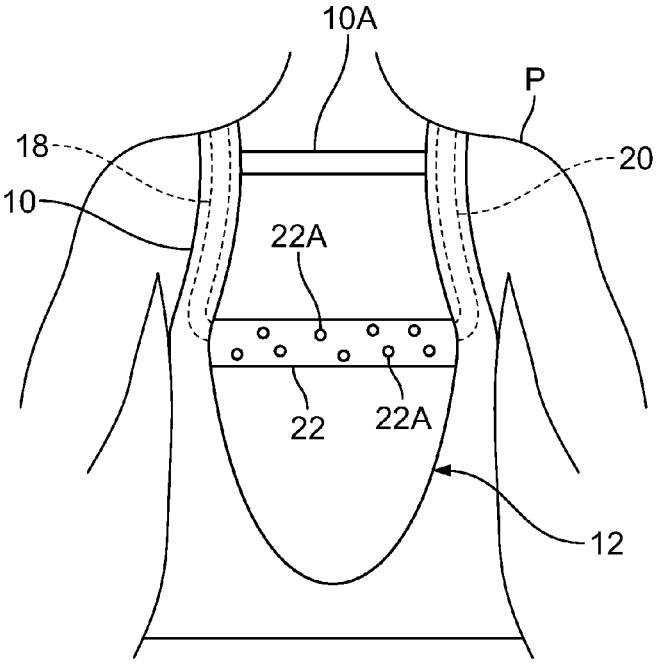
FIG. 5 is a rear elevational view of a person wearing an undergarment outfitted with a cover as shown in FIG. 4, the cover being adorned with decorative elements.

Stiffener 238 will have some flexibility, but will be able to stretch cover 222 to reach the shoulder straps (shoulder straps 18 and 20 of FIG. 1). Stiffener 238 may have a rectangular outline, but other outlines are anticipated as well. In some cases, the upper corners of stiffener 238 may be notched to provide clearance for the shoulder straps. The right and left end of stiffener 238 may be shaped to actually engage the shoulder straps and push them outwardly to conceal the straps below an outer garment. (See FIG. 5, showing concealment of shoulder straps). Stiffener 238 may be a sheet of plastic, metal, cardboard, composite materials, etc. In some embodiments the stiffener may be made as a row of flexible rods that are held together by glue, welds, a sheath, etc.

Cover 222 may be installed over back strap 16 in the manner described above, with stiffener 238 positioned to push the shoulder straps outwardly.

Figure 9:
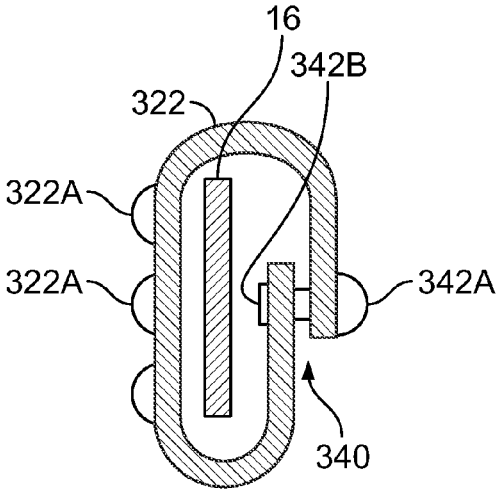
FIG. 9 is a cross-sectional view of a cover that is an alternate to that shown in the above Figures.

In some cases the bra will not have a clasp at the back strap, but will instead be clasped in the front. The embodiment of FIG. 9 will accommodate such a bra. In FIG. 9 cover 322 is shown as a tube with a longitudinal split 340. Specifically, the longitudinal edges of split 340 overlap and are held together with snap elements 342A and 342B. Snap elements 342A and 342B may be a series of snaps equidistantly spaced along longitudinal split 340. In this embodiment snap elements 342A and 342B are located on the inward side (skin side) of cover 322, and decorative elements 322A are attached on the outside. In some embodiments snap element 342A may have a decorative head and will be positioned to the outside.

Cover 322 may be installed by wrapping it around back strap 16 and then closing snap elements 342A and 342B. This installation may take place before the bra is donned and secured by closing the bra's front clasp (not shown).

Figure 10:
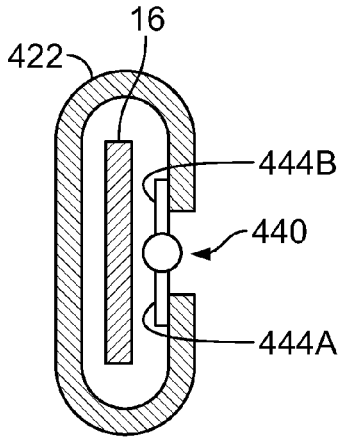
FIG. 10 is a cross-sectional view of a cover that is an alternate to that shown in the above Figures.

Referring to FIG. 10, cover 422 is a tubular structure with a longitudinal split 440 that may be closed with a zipper, shown as complementary elements 444A and 444B secured to opposite edges of the longitudinal split. Cover 422 may be installed as previously described in connection with FIG. 9, except that split 440 is closed by closing the zipper 444A/444B in the conventional manner.

Figure 11:
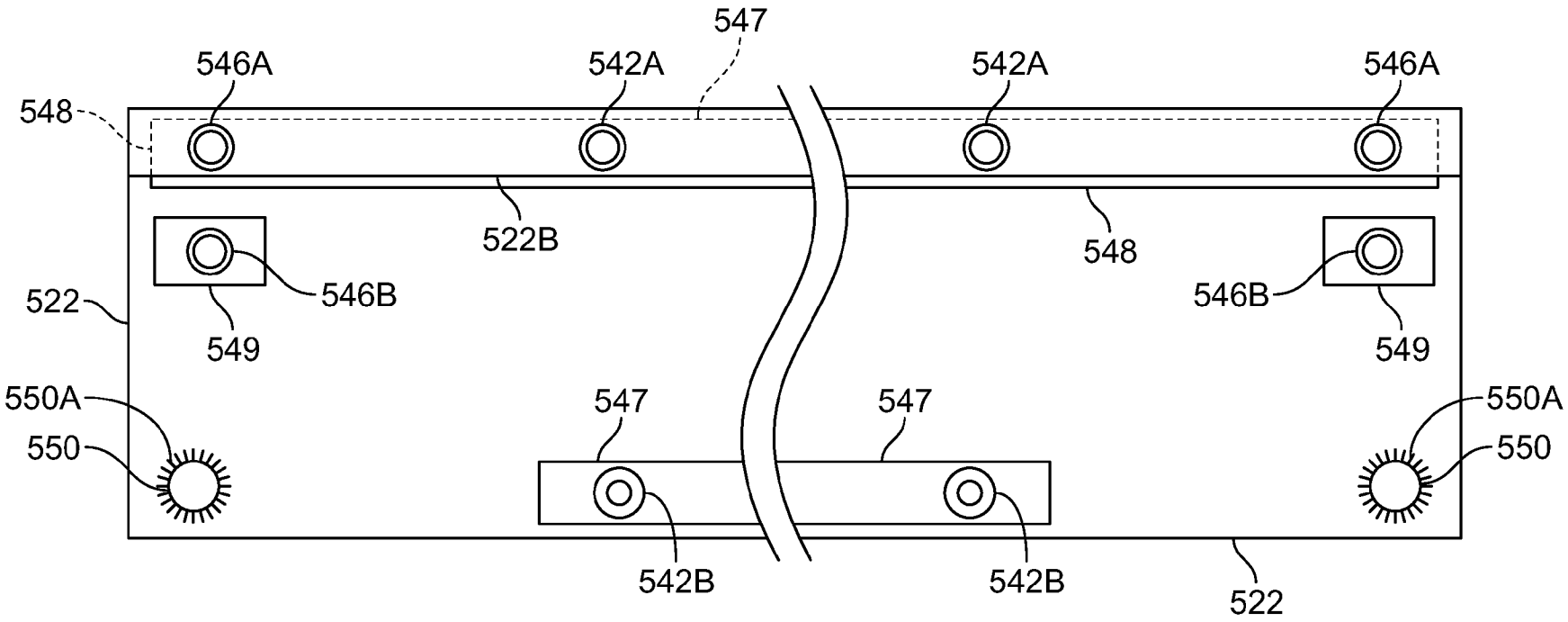
FIG. 11 is a plan view of a cover that is an alternate to that shown in the above Figures.

Referring to FIG. 11, the inside of alternate cover 522 is shown as a rectangular panel formed of any of the materials previously mentioned. The long upper edge and long lower edge of cover 522 is referred to as a first and a second longitudinal edge, respectively. The four corners of cover 522 are shown sharp, but may be rounded in some embodiments.

In a manner to be described presently, cover 522 may be rolled and closed using female snaps 542A and male snaps 542B to form a tube with a longitudinal split (similar to cover 322 of FIG. 9) FIG. 11 shows the sockets of snaps 542A and the base of snaps 542B, that is, the reverse side of snaps 542B have the lugs that will connect to the sockets of snaps 542A. Snaps 542A and 542B are referred to herein as closure devices that are part of a closure.

Because it may not be sufficiently strong, the material of cover 522 is overlaid with reinforcing strip 547 before installing snaps 542B. Strip 547 may be cloth, plastic, or other material adequate to reinforce snaps 542B. The opposite edge of cover 522 has a reinforcing strip 548 that is placed in the fold of hem 522B before installing snaps 542A. Remaining in the fold of hem 522B, reinforcing strip 548 extends to a position near the corners of cover 522 to reinforce female corner snaps 546A (a closure implement whose socket side is visible in this view).

The purpose of the foregoing snaps is to form a tubular cover having at each end, a pair of passageways (such passageways are shown in FIG. 3 with snap 26A dividing opening 24 into two passageways for straps 16 and 18). In principle, the division into a pair of passageways could be performed with four snaps: two snaps at an end of cover 522 to form the tube, and two more to divide the tube opening into two passageways. That much snap hardware would tend to crowd the end of cover 522, reducing the stretchability of the cover and leaving little room for the passage of a bra's backstrap and shoulder strap.

Instead, this embodiment gives previously mentioned snap 546A two separate connection points, namely, snap fastener 546B and aperture 550. Specifically, two apertures 550 are formed in the corners opposite snaps 546A and are reinforced with peripheral stitches 550A, similar to a buttonhole. Male snaps 546B (lug side shown in this view) are spaced from snaps 546A about one quarter of the way toward apertures 550. The snaps 546B are installed on reinforcing strips 549, which lie on cover 522.

Figure 12:
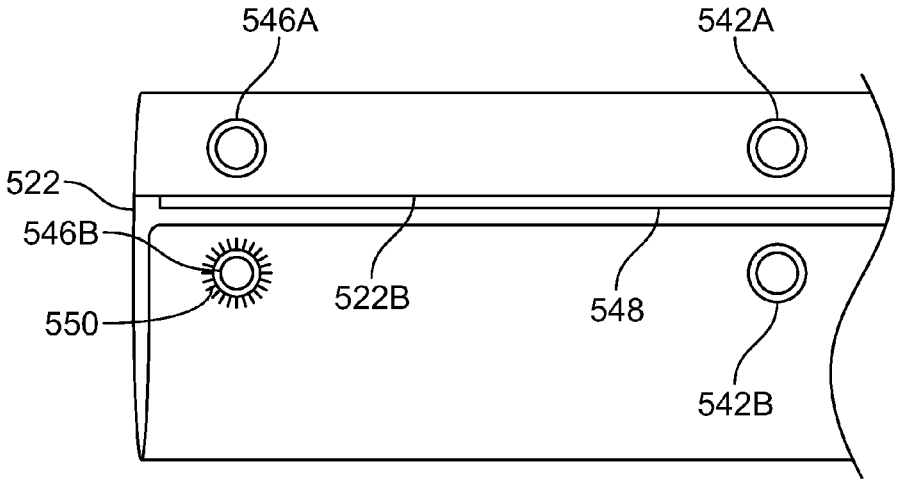
FIG. 12 is a fragmentary, elevational view of one end of the cover of FIG. 11 that is folded but unfastened.

As will be described presently, cover 522 can be folded to embrace a backstrap (e.g. the portion of backstrap 16 of FIG. 3 between shoulder straps 18 and 20). Referring specifically to FIG. 12, cover 522 is initially folded lengthwise so that at each end, snap 546B is aligned with aperture 550.

Figure 13:
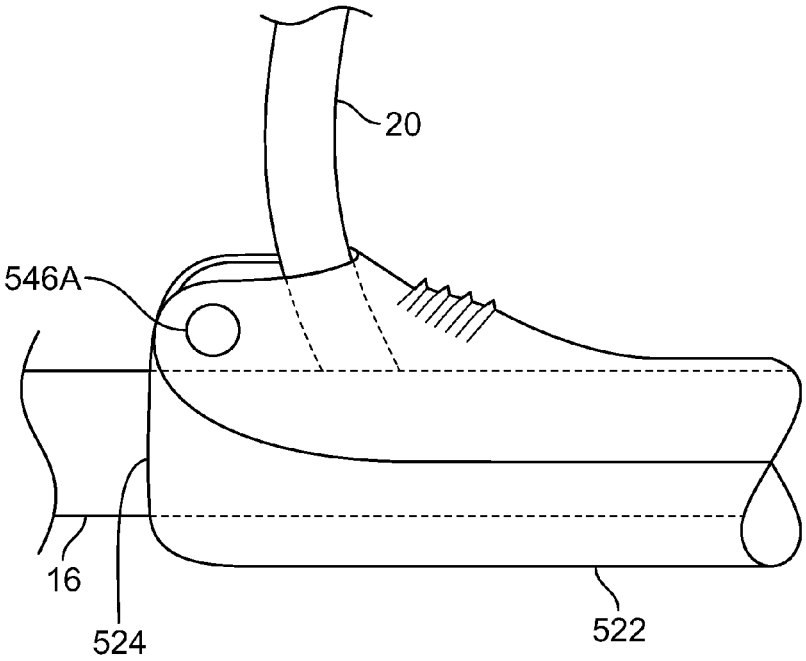
FIG. 13 is fragmentary, perspective of one end of the cover of FIG. 11 shown installed on an undergarment.

Comparing the progression from FIG. 12 to FIG. 13, cover 522 has been folded a second time, halfway between snaps 542A and 542B before fastening those snaps together to form a tubular structure for capturing the bra's backstrap 16.

The opening 524 at the end of cover 522 (FIG. 13) is stretched to accommodate backstrap 16 and shoulder strap 20. Specifically, the portion of cover 522 below elements 546B and 550 is stretched to accommodate backstrap 16. Likewise, the portion of cover 522 above elements 546B and 550 is stretched to accommodate shoulder strap 20. With cover 522 stretched in this manner and straps 16 and 20 positioned as shown in FIG. 13, snap 546A may be folded down to connect to the lug of snap 546B protruding through aperture 550.

The foregoing stretching produces tension that tends to outwardly bow and conceal shoulder strap 20 in the manner previously described (see for example FIG. 3).

FIG. 13 shows installation around right shoulder strap 20, and a complementary installation will be performed on the left shoulder strap (similar to that shown in FIG. 3). FIG. 13 shows the inward facing side of cover 522, although in some embodiments this side can face outwardly. As before, the outwardly facing side of cover 522 can be adorned with decorative elements (not shown).

Obviously, many modifications and variations of the present invention are possible in light of the above teachings. It is therefore to be understood that within the scope of the appended claims, the invention may be practiced otherwise than as specifically described.

The invention claimed is:

1. A cover for an undergarment having a back strap and a pair of shoulder straps, said cover comprising:

a casing for covering said back strap, said casing being adapted to extend from one of the pair of shoulder straps to the other, said casing having an opposing pair of openings; and a pair of releasable fasteners separately located at different ones of said pair of openings, said pair of fasteners each having a spaced pair of mating elements on said casing, said pair of fasteners being operable to divide the pair of openings so each has a pair of passageways, one for the back strap and one for an associated one of the pair of shoulder straps.

2. A cover according to claim 1 wherein said pair of openings each have an annular rim, said pair of fasteners being operable to hold together spaced locations on the annular rim of said pair of openings and give each of the pair of passageways of each of the pair of openings an annular entranceway.

3. A cover according to claim 2 wherein said pair of fasteners are a pair of snaps.

4. A cover according to claim 1 wherein said pair of fasteners are a separate pair of straps adapted to be releasably connected across said pair of openings.

5. A cover according to claim 1 wherein said casing comprises a tube with a longitudinal split.

6. A cover according to claim 5 wherein said casing comprises a closure for closing said longitudinal split.

7. A cover for an undergarment having a back strap and a pair of shoulder straps, said cover comprising:

a casing for covering said back strap, said casing being adapted to extend from one of the pair of shoulder straps to the other, wherein said casing has opposite ends;

at least one fastener having a spaced pair of mating elements on said casing; and a stiffener mounted on said casing and extending between said opposite ends of said casing for outwardly urging the ends of said casing against the pair of shoulder straps.

8. A cover according to claim 1 wherein said cover comprises:

at least one decorative element adorning said casing.

* * * * *